US005871121A

United States Patent [19]

Hashimoto et al.

[11] Patent Number: 5,871,121

[45] Date of Patent: Feb. 16, 1999

[54] BEER VENDING MACHINE AND METHOD OF CONTROLLING PRESSURE IN A BEER BARREL

[75] Inventors: Masami Hashimoto; Masanobu Ishibashi, both of Mie, Japan

[73] Assignee: Fuji Electric Co., Ltd., Kawasaki, Japan

[21] Appl. No.: 708,058

[22] Filed: Aug. 30, 1996

[30] Foreign Application Priority Data

Sep. 8, 1995 [JP] Japan ..... 7-230593

[51] Int. Cl.[6] ..... B67D 5/08

[52] U.S. Cl. ..... 222/54; 222/61; 222/1

[58] Field of Search ..... 222/1, 54, 61, 222/394, 399, 396, 397, 146.6

[56] References Cited

U.S. PATENT DOCUMENTS 4,094,445 6/1978 Bevan ..... 222/1

4,869,396 9/1989 Horino et al. ..... 222/54

*Primary Examiner*—Andres Kashnikow
*Assistant Examiner*—David Deal
*Attorney, Agent, or Firm*—Kanesaka & Takeuchi

[57] ABSTRACT

A beer vending machine of the invention includes a cylinder containing compressed carbon dioxide gas, a gas regulator for adjusting a secondary pressure of the carbon dioxide gas, a temperature sensor for monitoring a beer temperature, gas and leak valves, and a pressure controller. The gas valve is disposed in a gas pipe line between the beer barrel and the gas regulator to open or close the gas pipe line, and the leak valve is disposed in a branch pipe for depressurizing the beer barrel. Based on the beer temperature obtained by the temperature sensor, the pressure controller controls the gas regulator, the gas valve and the leak valve to set the secondary pressure at an equilibrium pressure corresponding to the obtained beer temperature. Therefore, the beer barrel is pressurized under the suitable equilibrium pressure.

6 Claims, 4 Drawing Sheets

BEER VENDING MACHINE AND METHOD OF CONTROLLING PRESSURE IN A BEER BARREL

BACKGROUND OF THE INVENTION AND RELATED ART STATEMENT

The present invention relates to a beer vending machine which stores beer in beer barrels cooled in a refrigerator and serves the beer to a cup by further cooling the same by passing through a cooling coil, and a method of controlling pressure in the beer barrel.

FIG. 4 is a schematic drawing showing the structure of a conventional beer vending machine. Referring to FIG. 4, a cylinder 1 stores carbon dioxide gas therein. A gas regulator 2 regulates the pressure of the carbon dioxide gas on a secondary side thereof at a certain value. A pressure sensor 3 on the secondary side of the gas regulator 2 monitors the secondary pressure of the carbon dioxide gas. The carbon dioxide gas fed through the regulator 2 is distributed to beer barrels 7*a*, 7*b* through a gas distributor 4. Gas valves 5*a*, 5*b* disposed in gas feed pipes between the gas distributor 4 and the beer barrels 7*a* and 7*b* operate to supply and stop the carbon dioxide gas. Check valves 6*a* and 6*b* are disposed in the gas feed pipes near the beer barrel 7*a* and 7*b*. A temperature sensor 8 monitors the temperature of the beer stored in the barrels 7*a* and 7*b*.

The beer barrels 7*a*, 7*b* are stored and cooled in a refrigerator. For vending the beer, one of the gas valves 5*a* and 5*b* is opened and the carbon dioxide gas is fed through the gas distributor 4 to either one of the beer barrels 7*a* or 7*b* at a predetermined pressure regulated by the gas regulator 2 and monitored by the pressure sensor 3. The beer stored in the barrel 7*a* or 7*b* is pushed out by the pressure of the carbon dioxide gas, cooled while flowing through a cooling pipe (not shown) connected to a piping on the secondary side of the barrels 7*a* and 7*b*, and served to a cup or cups. The check valves 6*a*, 6*b* are disposed between the gas valves 5*a*, 5*b* and the beer barrels 7*a*, 7*b* to prevent the beer from flowing back to the gas distributor 4.

The preferable storing temperature of the beer is 25° C. or lower before the beer barrel is stored in the refrigerator of the vending machine, and in the refrigerator, the beer is cooled down in a range of 10° to 12° C. At the exit end of the cooling pipe, i.e. where the beer is poured into the cup, the beer, even if supplied at 25° C., is cooled down into 1° to 5° C.

When the beer temperature monitored by the temperature sensor 8 is outside the range between 10° and 12° C., the gas regulator 2 is manually adjusted to regulate the gas pressure and to push out the beer under the pressure suitable to the beer temperature.

It is preferable to keep the internal pressure in the beer barrel at the equilibrium pressure at which the dissolution rate of the carbon dioxide gas to the beer is equal to the dissociation rate of carbon dioxide gas from the beer. The equilibrium pressure rises as beer temperature increases. When the internal barrel pressure is much lower than the equilibrium pressure, it becomes vapid beer with no bubble head. When the internal barrel pressure is much higher than the equilibrium pressure, beer becomes too bubbly and too bitter.

When the beer is stored at the normal temperature, it is preferable that the storage temperature is 25° C. or lower. When the storage temperature exceeds 30° C., the beer loses its flavor quickly. The aforementioned equilibrium pressure is 3 to 4 kg/cm$^2$ for the beer temperature of around 25° C., and 1 to 2 kg/cm$^2$ for the beer temperature of 10° C. or lower.

If a replaced beer barrel has not been sufficiently cooled before vending, vapid beer will be served. If the gas regulator 2 has been adjusted such that the internal pressure in the beer barrel at the secondary side is raised to prevent the vapid beer, the internal pressure of the beer barrel will be too higher than the equilibrium pressure after the beer is sufficiently cooled in the refrigerator of the vending machine. Therefore, the internal pressure of the beer barrel should be reduced into the equilibrium pressure.

However, the internal pressure of the beer barrel can not be reduced in the conventional beer vending machine, since the check valves 6*a*, 6*b* are disposed in the feeder piping on the upstream side of the beer barrels 7*a* and 7*b*. When the beer is served under the pressure much higher than the equilibrium pressure, the amount of served beer will vary from cup to cup because of too many bubbles. Therefore, while the beer is not cooled sufficiently, there is no way but to vend vapid beer without pressurizing the beer barrel or to stop vending and wait until the new beer barrel is cooled sufficiently. Thus, the beer with poor quality will be served or sales chances will be lost.

In view of the foregoing, it is an object of the invention to provide a beer vending machine, which facilitates vending a predetermined amount of beer with a constant bubble head.

It is another object of the invention to provide a beer vending machine, which facilitates meticulously pressurizing the beer barrel under the equilibrium pressure corresponding to the beer temperature.

It is still another object of the invention to provide a method of pressurizing the beer barrels in the vending machine which facilitates pressurizing the beer barrel under the equilibrium pressure corresponding to the beer temperature.

SUMMARY OF THE INVENTION

According to an aspect of the present invention, there is provided a beer vending machine which serves beer from a beer barrel. The beer vending machine is provided with a cylinder containing compressed carbon dioxide gas; a gas regulator for adjusting a secondary pressure of the carbon dioxide gas on a secondary side of the gas regulator; a gas pipe line connecting the gas regulator and the beer barrel, the gas pipe line having a branch pipe; a gas valve disposed in the gas pipe line; a temperature sensor for monitoring the temperature of the beer in the beer barrel; a leak valve disposed in the branch pipe for reducing pressure in the beer barrel; and a pressure controller for controlling the gas regulator, the gas valve and the leak valve based on the beer temperature to set the secondary pressure at the equilibrium pressure value corresponding to the beer temperature and to pressurize the inside of the beer barrel under the equilibrium pressure.

Advantageously, in the beer vending machine of the invention, the pressure controller is provided with first memory means for memorizing a predetermined temperature of the beer suitable for cooling and storing the beer, and for storing a conversion table for showing a relationship between values of the equilibrium pressure and temperatures of the beer; second memory means for memorizing the last value of the beer temperature; first comparing means for comparing the present value of the beer temperature sent from the temperature sensor and the predetermined temperature; means for sending a reference signal to the gas regulator when the present value of the beer temperature is higher than the predetermined temperature, the reference signal allowing the secondary pressure to become the equilibrium pressure corresponding to the present value of the beer temperature; second comparing means for comparing the present value of the beer temperature with the last value of the beer temperature; first transmitting means for transmitting a first command signal to the leak valve when the present value of the beer temperature is lower than the last value of the beer temperature, the first command signal commanding the leak valve to open for a predetermined period of time so as to depressurize the beer barrel; and second transmitting means for transmitting a second command signal to the gas valve, the second command signal commanding the gas valve to open so as to pressurize the beer barrel under the equilibrium pressure corresponding to the present value of the beer temperature.

According to another aspect of the invention, there is provided a method of controlling pressure in a beer barrel in the beer vending machine which is formed of a cylinder containing compressed carbon dioxide gas, a gas regulator for adjusting a secondary pressure of the carbon dioxide gas on a secondary side of the gas regulator, a gas pipe line for connecting the gas regulator to the beer barrel and having a branch pipe, a gas valve disposed in the gas pipe line, a temperature sensor for detecting the beer temperature in the beer barrel, and a leak valve disposed in the branch pipe for depressurizing the beer barrel. The method includes periodically detecting the beer temperature, comparing the beer temperature with a predetermined temperature suitable for cooling and storing the beer, and pressurizing the beer in the beer barrel under the equilibrium pressure corresponding to the beer temperature.

Advantageously, the method further includes obtaining the equilibrium pressure corresponding to the beer temperature when the beer temperature is higher than the predetermined temperature (e.g. 12° C.), regulating the secondary pressure to the obtained equilibrium pressure, comparing the present value of the beer temperature with the last value of the beer temperature, and opening the gas valve disposed in the gas pipe line, to pressurize the beer in the beer barrel under the obtained equilibrium pressure.

Advantageously, the method further includes opening the leak valve for a certain period of time when the present value of the beer temperature is lower than the last value of the beer temperature to depressurize the beer barrel before opening the gas valve.

The equilibrium pressure is the pressure under which the dissolution rate of the carbon dioxide gas to the beer is equal to the dissociation rate of the carbon dioxide gas from the beer at the beer temperature.

The automatic pressure controller of the invention memorizes the equilibrium pressure values corresponding to the beer temperatures, periodically detects a beer temperature now stored, obtains a equilibrium pressure corresponding to the detected beer temperature, and regulates the secondary pressure of carbon dioxide gas to become the equilibrium pressure. The automatic pressure controller of the invention memorizes the last value of the beer temperature, and compares the present beer temperature with the last beer temperature. When the present beer temperature is higher than the last beer temperature, the automatic pressure controller opens the gas valve and pressurizes the beer in the beer barrel under the equilibrium pressure corresponding to the present beer temperature.

When the present beer temperature is lower than the last beer temperature, the automatic pressure controller opens the leak valve for a certain period of time to reduce the pressure in the beer barrel, opens the gas valve and pressurizes the beer in the beer barrel under the equilibrium pressure corresponding to the present beer temperature. The reduction of pressure in the beer barrel is controlled by a period of time when the leak valve is opened. The above described control is repeated until the beer temperature is stabilized between 10° and 12° C.

DETAILED DESCRIPTION OF PREFERRED EMBODIMENTS

Figure 4:
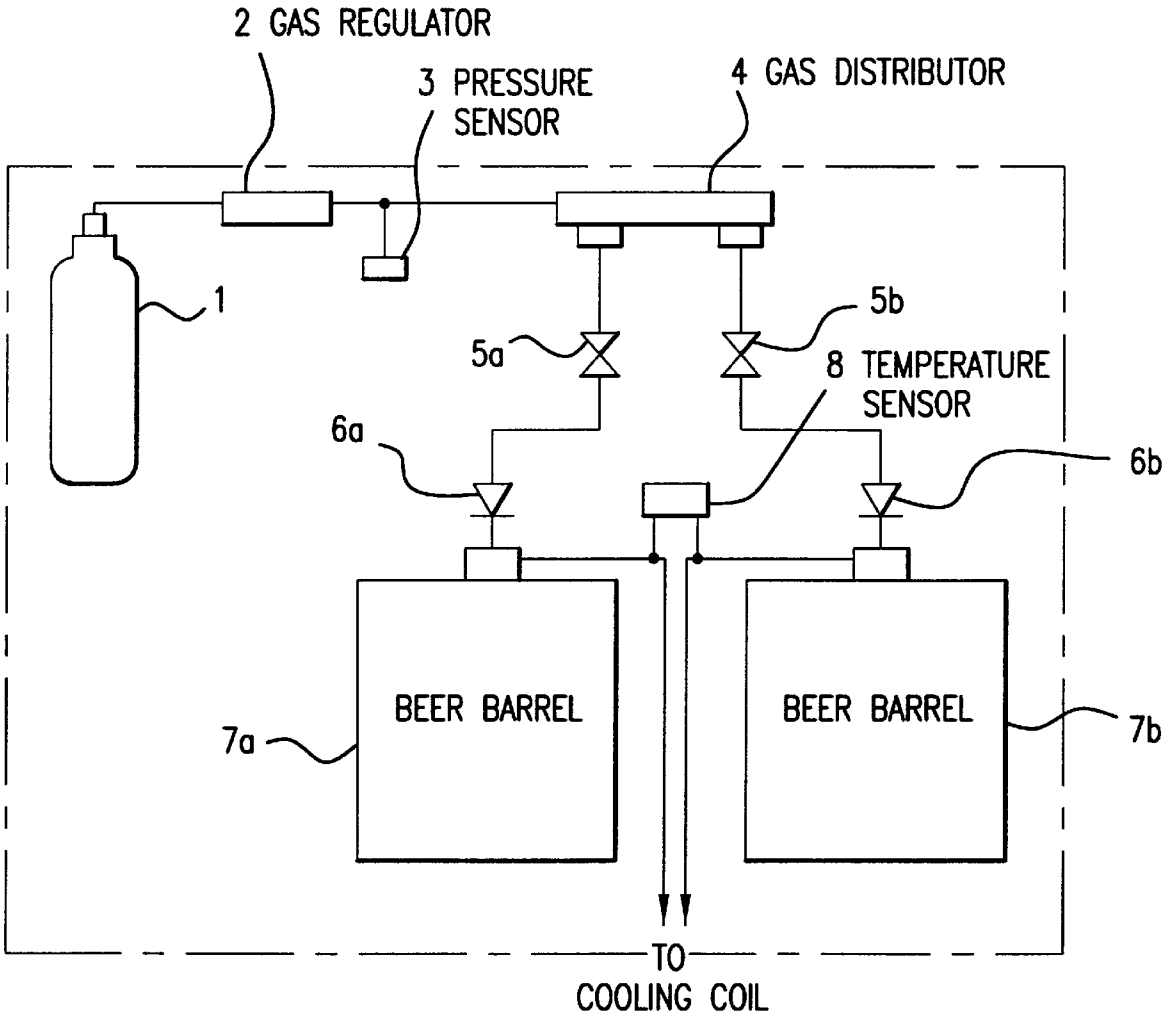
FIG. 4 PRIOR ART
FIG. 4 is a schematic drawing showing a structure of a conventional beer vending machine.

Now the present invention will be explained in detail hereinafter with reference to the accompanied drawings which illustrate a preferred embodiment of the invention. Throughout these figures, similar parts with those of FIG. 4 are designated by the similar reference numerals.

Figure 1:
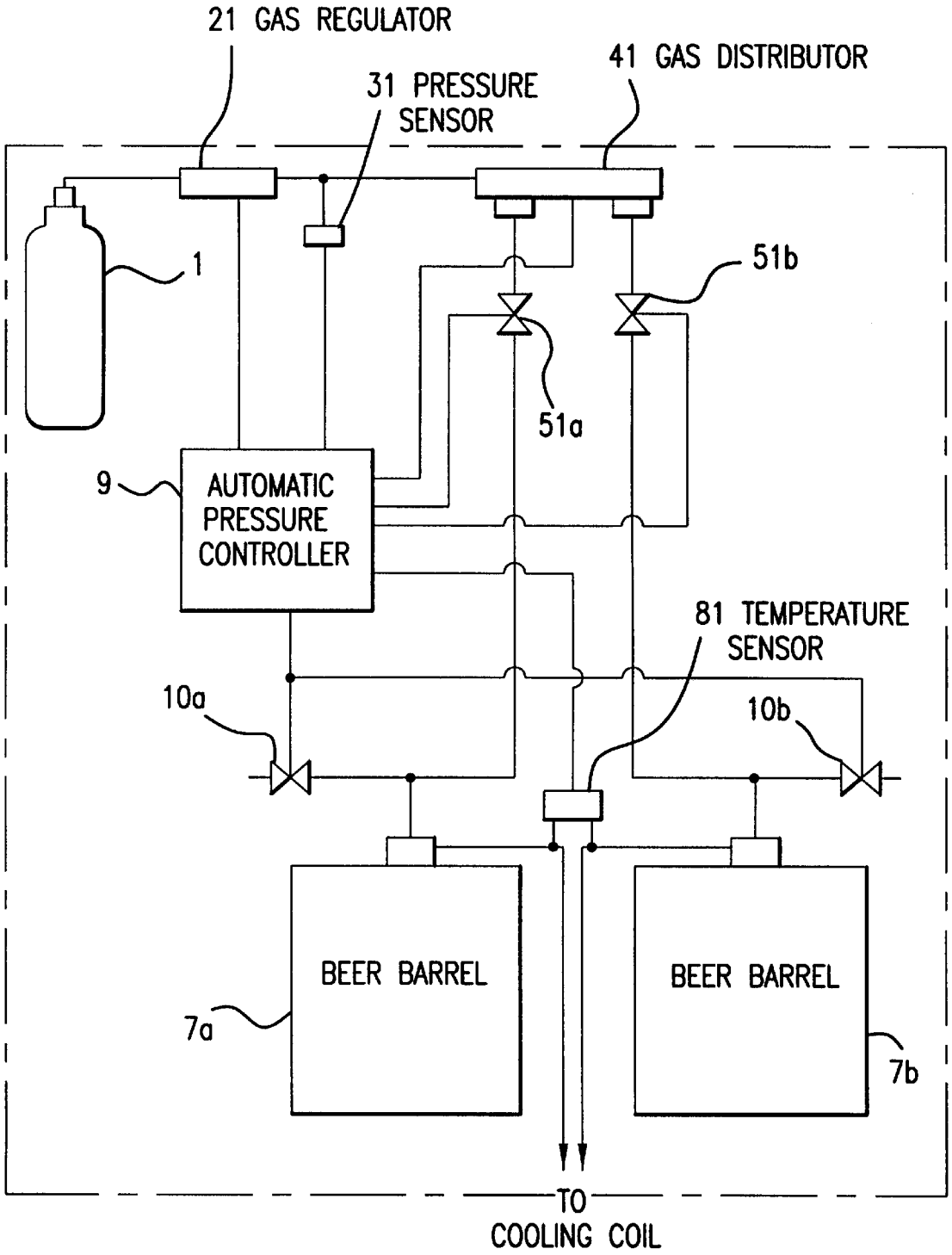
FIG. 1 is a schematic drawing showing a structure of a beer vending machine according to the present invention.

FIG. 1 is a schematic drawing showing a structure of a beer vending machine according to the present invention. Referring to FIG. 1, a cylinder 1 stores carbon dioxide gas therein. A gas regulator 21 regulates a pressure of the carbon dioxide gas on a secondary side thereof at a certain value. A pressure sensor 31 on the secondary side of the gas regulator 21 monitors the secondary pressure of the carbon dioxide gas. The carbon dioxide gas fed through the regulator 21 is distributed to beer barrels 7*a*, 7*b* through a gas distributor 41. Gas valves 51*a*, 51*b* disposed in gas feed pipes between the gas distributor 41 and the beer barrels 7*a*, 7*b* allow or interrupt the flow of the carbon dioxide gas. A temperature sensor 81 monitors the temperature of the beer stored in the barrels 7*a* and 7*b*. The gas feed pipes have respective side branches, and leak valves 10*a*, 10*b* are disposed in the respective side branches.

An automatic pressure controller 9 is installed in the beer vending machine of the invention for controlling the secondary pressure of the carbon dioxide gas. The controller 9 is connected to the gas regulator 21, the pressure sensor 31, the gas distributor 41, the gas valves 51*a*, 51*b*, the temperature sensor 81, and the leak valves 10*a*, 10*b*.

The gas regulator 21 has an actuator (not shown) for actuating the valve thereof. The pressure sensor 31 has a transmitter (not shown) for sending the value of the secondary gas pressure to the controller 9. The gas distributor 41 has a transmitter (not shown) for informing the switching between the pipe line systems "a" and "b" to the controller 9. The gas valves 51*a*, 51*b* have respective actuators (not shown) for opening and closing the valves thereof. The temperature sensor 81 has a transceiver (not shown) which receives a command signal from the controller 9 and sends information of the latest beer temperature to the controller 9 in response to the command signal. And, the leak valves 10*a*, 10*b* have respective actuators (not shown) for opening and closing the valves thereof.

The beer barrels 7*a*, 7*b* are stored and cooled in a refrigerator (not shown) of the vending machine. When the vending machine is used, the gas valve 51*a* or 51*b* is opened and the carbon dioxide gas is fed through the gas distributor 41 to the beer barrel 7*a* or 7*b* under a certain pressure regulated by the gas regulator 21 and monitored by the pressure sensor 31. The beer stored in the barrel 7*a* or 7*b* is pushed out by the pressure of the carbon dioxide gas, cooled while flowing through a cooling pipe (not shown) connected to a piping on the secondary side of the barrels 7*a* and 7*b*, and served to a cup or cups.

When a beer barrel, e.g. 7*b*, is empty, the vending pipe line is switched over from "b" to "a", i.e. to the remaining full beer barrel 7*a*, and the empty barrel 7*b* is replaced by a new full barrel which has been stored at the normal temperature. When the beer barrel 7*a* has not been sufficiently cooled, the beer temperature in the barrel 7*a* is higher than the last temperature which is the temperature of the beer in the barrel 7*b* just before replacement. Therefore, the controller 9 controls the gas regulator 21 to raise the secondary pressure of the carbon dioxide gas, while monitoring the secondary pressure detected by the pressure sensor 31, to the equilibrium pressure corresponding to the present measured beer temperature. Then, the controller 9 opens the gas valve 51*a* to pressurize the barrel 7*a*. After a predetermined period of time, the measured beer temperature will be lower than the last temperature, since the beer barrel 7*a* has been cooled at least for the predetermined period. When the present beer temperature is lower than the last one, the controller 9 controls the gas regulator 21 to adjust the secondary pressure of the carbon dioxide gas to the equilibrium pressure corresponding to the present beer temperature, opens the leak valve 10*a* to lower the internal pressure of the beer barrel 7*a*, closes the leak valve, and then opens the gas valve 51*a* to pressurize the beer barrel 7*a* under the equilibrium pressure.

Figure 2:
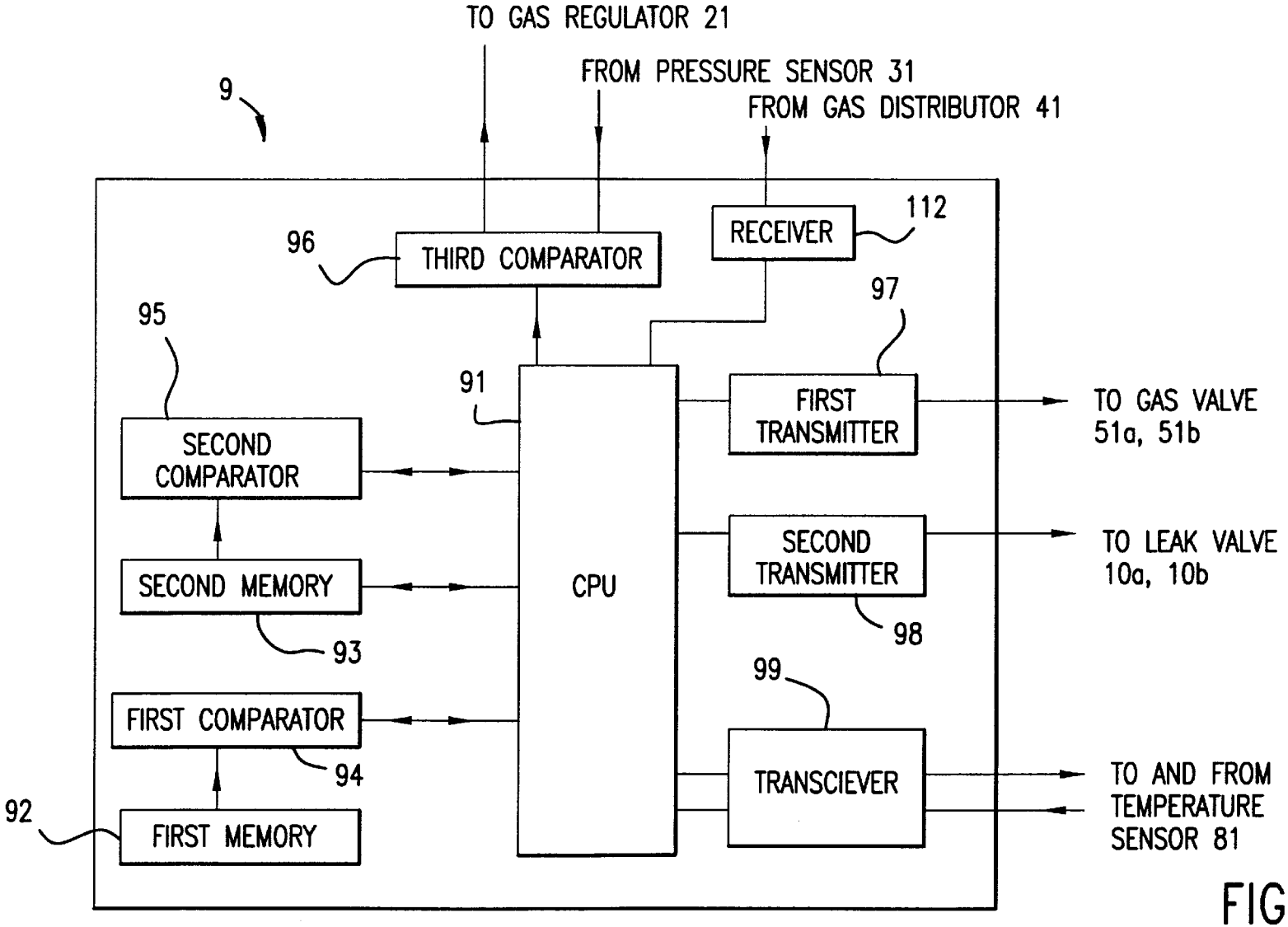
FIG. 2 is a block diagram of an automatic pressure controller shown in FIG. 1.

FIG. 2 is a block diagram of the automatic pressure controller of FIG. 1. Referring to FIG. 2, the automatic pressure controller 9 includes a CPU 91; a first memory 92; a second memory 93; a first comparator 94; a second comparator 95; a third comparator 96; a first transmitter 97; a second transmitter 98; a transceiver 99; and a receiver 112.

In FIG. 2, arrows indicate flow directions of command signals and data signals. The CPU 91 controls entire operations in the controller 9. The first memory 92 memorizes the desirable temperature $T_R$ of the beer barrel stored, e.g. 12° C., in the refrigerator of the vending machine and a conversion table which shows relationship between the beer temperatures and equilibrium pressure values for the beer in the barrel corresponding thereto. The second memory 93 temporarily memorizes the latest beer temperature measured at the last time. The first comparator 94 compares the present beer temperature measured by the temperature sensor 81 with the desirable temperature $T_R$ read out from the first memory 92. The second comparator 95 compares the present beer temperature inputted from the temperature sensor 81 with the latest beer temperature stored in the second memory 93. The third comparator 96 compares the equilibrium pressure from the second memory 93 with the secondary gas pressure sent from the pressure sensor 31 and sends a reference signal, indicative of the pressure difference, to the actuator of the gas regulator 21.

The third comparator 96, the gas regulator 21 and the pressure sensor 31 constitute a gas pressure control loop for controlling the secondary pressure of the carbon dioxide gas. The receiver 112 receives a signal, indicating which pipe line system "a" or "b" is currently used, from the transmitter of the gas distributor 41. The first transmitter 97 sends a command signal to the actuator of the valve 51*a* or 51*b* for opening or closing of the gas valve 51*a* or 51*b*. The second transmitter 98 sends a command signal to the actuator of the valve 10*a* or 10*b* for opening or closing of the leak valve 10*a* or 10*b*. The transceiver 99 sends a command signal for actuating the transceiver of the temperature sensor 81 and receives a temperature signal of the latest beer temperature returned from the temperature sensor 81 in response to the command signal.

Figure 3:
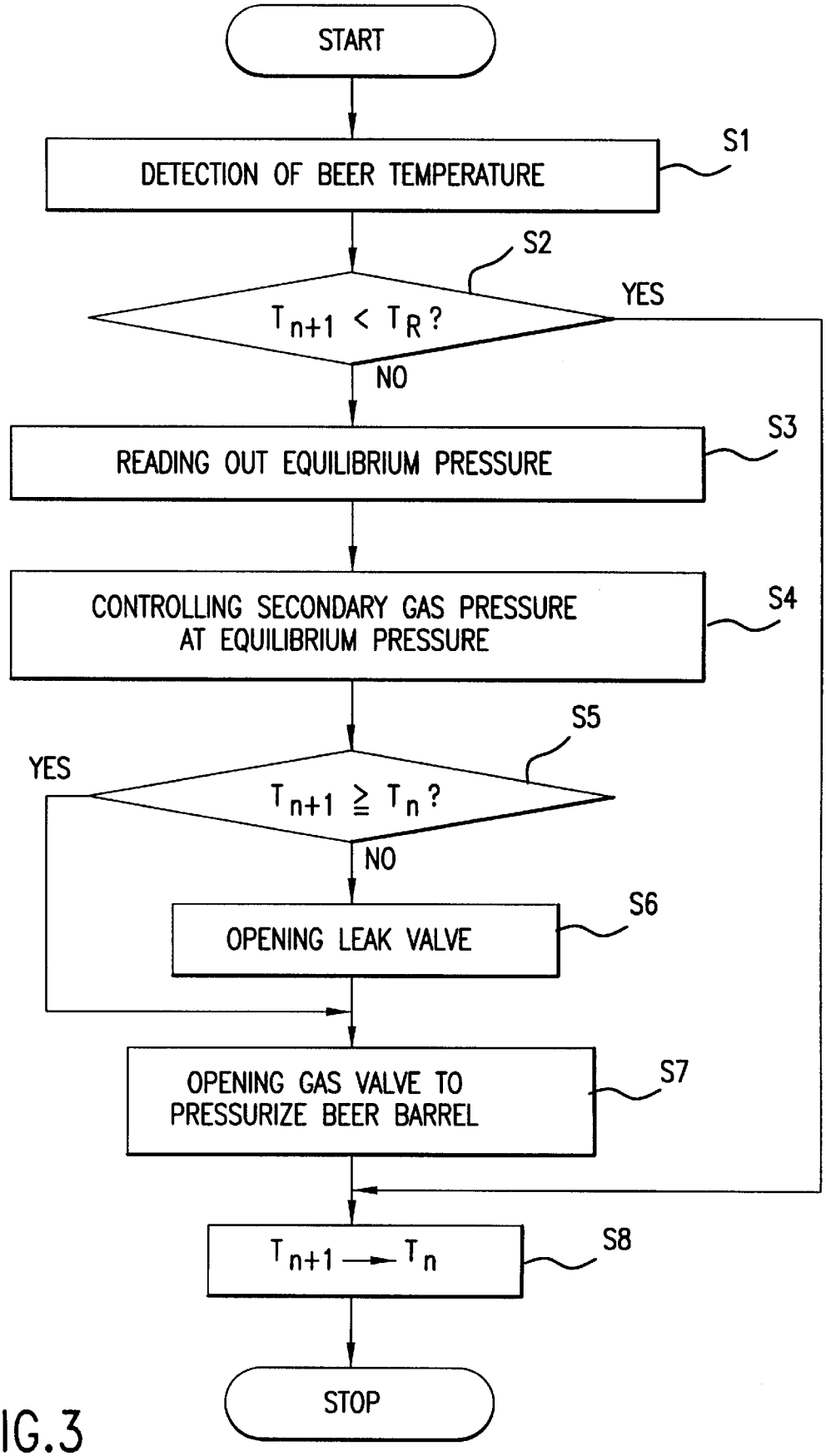
FIG. 3 is a flow chart showing an operation by a controller of the invention for pressurizing beer in a beer barrel.

FIG. 3 is a flow chart of the operations in the controller 9 for pressurizing the beer in the beer barrel. Referring to FIG. 3, the CPU 91 periodically monitors through the transceiver 99 the beer temperature from the temperature sensor 81 (S1). The first comparator 94 compares the present beer temperature with the predetermined temperature $T_R$ (the preferable refrigeration temperature: 10° to 12° C.) stored in the first memory 92 (S2). If the present beer temperature $T_{n+1}$ is less than the predetermined temperature $T_R$ of the beer, the CPU 91 replaces the last beer temperature $T_n$ in the second memory 93 with the present temperature $T_{n+1}$ (S8) and waits until next control cycle starts, since the inside of the beer barrel is under the equilibrium pressure.

If the present beer temperature $T_{n+1}$ is higher than the predetermined temperature $T_R$ of the beer, the CPU 91 looks up the conversion table in the first memory 92 and reads out the equilibrium pressure corresponding to the present beer temperature (S3). The third comparator 96 compares the equilibrium pressure corresponding to the present beer temperature with the secondary gas pressure sent from the pressure sensor 31 and sends a reference signal indicating the pressure difference to the gas regulator 21, and the gas regulator 21 controls the secondary pressure of the carbon dioxide gas to become the equilibrium pressure (S4). The pressure sensor 31 monitors the regulated secondary gas pressure and transmits the secondary gas pressure value to the third comparator 96. Then, the second comparator 95 compares the present beer temperature $T_{n+1}$ with the last beer temperature $T_n$ stored in the second memory 93 (S5). If the present temperature $T_{n+1}$ is equal to or higher than the last temperature $T_n$ of the beer, the internal pressure of the beer barrel is lower than the equilibrium pressure, i.e. reduced pressure, corresponding to the present beer temperature. Therefore, the CPU 91 sends, through the first transmitter 97, a command signal to the gas valve 51*a* or 51*b*. In response to the command signal, the gas valve 51*a* or 51*b* opens to pressurize the beer barrel to become the equilibrium pressure adjusted by the gas regulator 21 in S4 (S7).

If the present beer temperature $T_{n+1}$ is lower than the last temperature $T_n$ of the beer, the internal pressure of the beer barrel is higher than the equilibrium pressure corresponding to the present beer temperature. Therefore, the CPU 91 sends a command signal through the second transmitter 98 to the leak valve 10*a* or 10*b*. In response to the command signal, the leak valve 10*a* or 10*b* opens for a certain period to reduce the internal pressure of the barrel 7*a* or 7*b* (S6). Then, the CPU 91 sends a command signal to the gas valve 51*a* or 51*b*. In response to the command signal, the gas valve 51*a* or 51*b* opens to pressurize the beer barrel under the equilibrium pressure adjusted by the gas regulator 21 in the S4 (S7). Finally, the CPU 91 replaces the last beer temperature $T_n$ in the second memory with the present one $T_{n+1}$ (S8) and waits until the next temperature control cycle starts.

According to the invention, the bubble heads in the cups of beer are almost equalized even when insufficiently cooled beer is served into the cups from the beer barrel which have been stored at the normal temperature before mounting in the vending machine. Thus, the beer vending machine and the method of pressurizing the beer barrel according to the invention facilitate to serve an equal amount of beer into a cup all the time.

What is claimed is:

1. A beer vending machine for providing beer from a beer barrel, comprising:

a cylinder having compressed carbon dioxide gas therein;

a gas regulator connected to the cylinder for adjusting a secondary pressure of said carbon dioxide gas;

a gas pipe line situated between the gas regulator and the beer barrel and having a branch pipe;

a gas valve disposed in the gas pipe line;

a gas distributor situated in the gas pipe line between the gas regulator and the gas valve;

a temperature sensor connected to the beer barrel for monitoring a beer temperature of the beer in the beer barrel;

a leak valve disposed in the branch pipe for reducing pressure in the beer barrel;

additional gas line attached to the gas distributor and having an additional leak valve and an additional gas valve, an additional beer barrel being attached to the additional gas line for replacement and connected to the temperature sensor; and a pressure controller connected to the gas regulator, the gas valve additional gas valve, leak valve and additional leak valve for controlling the gas regulator, the gas valve, additional gas valve, leak valve and additional leak valve based on the beer temperature to be regulated so that the secondary pressure of the carbon dioxide gas from the gas regulator becomes an equilibrium pressure corresponding to the beer temperature and the beer barrel to be regulated is pressurized to the equilibrium pressure.

2. A beer vending machine according to claim 1, wherein said equilibrium pressure is a pressure under which a dissolution rate of the carbon dioxide gas to the beer is equal to a dissociation rate of the carbon dioxide gas from the beer at one beer temperature.

3. A beer vending machine according to claim 1, wherein said pressure controller comprises:

first memory means for memorizing a predetermined beer temperature suitable for cooling and storing the beer, and a conversion table for providing relation of values of equilibrium pressures with respect to beer temperatures, respectively;

second memory means for memorizing a latest value of a beer temperature detected by the temperature sensor;

first comparing means electrically connected to the first memory means for comparing a present value of a beer temperature sent by the temperature sensor with the predetermined beer temperatures in the first memory means;

means for sending a reference signal to said gas regulator when said present value of said beer temperature is higher than said predetermined temperature, said reference signal indicating a pressure difference between the equilibrium pressure corresponding to the present value of the beer temperature and a present value of the secondary pressure;

second comparing means electrically connected to the second memory means for comparing the present value of the beer temperature with the latest value of the beer temperature;

first transmitting means electrically connected to the leak valve for transmitting a first command signal to the leak valve when the present value of the beer temperature is lower than the latest value of the beer temperature, which is compared in the second comparing means, said first command signal commanding said leak valve to open for a predetermined period of time so as to reduce a pressure in the beer barrel; and second transmitting means electrically connected to the gas valve for transmitting a second command signal to said gas valve, said second command signal commanding said gas valve to open so that said beer barrel is pressurized under one of the equilibrium pressures corresponding to the present value of the beer temperature.

4. A method of controlling a beer vending machine for providing beer from a beer barrel, comprising:

periodically detecting a beer temperature of the beer in the beer barrel;

comparing said beer temperature with a predetermined beer temperature suitable for cooling and storing the beer;

obtaining an equilibrium pressure corresponding to the beer temperature when the beer temperature is different from the predetermined temperature, said equilibrium pressure being a pressure under which a dissolution rate of carbon dioxide gas to said beer is equal to a dissociation rate of carbon dioxide from said beers;

regulating a pressure of a carbon dioxide gas to be supplied to correspond to the equilibrium pressure; and comparing a present value of the beer temperature with a last value of the beer temperature;

wherein when said present value of the beer temperature is higher than the last value of the beer temperature, a gas valve for the carbon dioxide gas to be supplied is opened to pressurize the beer in the beer barrel under the equilibrium pressure, and when said present value of the beer temperature is lower than the last value of the beer temperature, a leak valve is opened for a certain period of time to reduce a pressure in the beer barrel and then the gas valve is opened to pressurize the beer in the beer barrel under the equilibrium pressure.

5. A method of controlling a beer barrel according to claim 4, wherein said beer vending machine is provided with a cylinder containing a compressed carbon dioxide gas; a gas regulator attached to the cylinder for adjusting a secondary pressure of the carbon dioxide gas on a secondary side of said gas regulator; a gas pipe line connecting said gas regulator to said beer barrel, said gas pipe line having a branch pipe; a gas valve disposed in said gas pipe line; a temperature sensor attached to the beer barrel for detecting the beer temperature in said beer barrel; and a leak valve disposed in said branch pipe for reducing pressure in said beer barrel.

6. A method according to claim 4, further comprising preparing separate gas lines for providing the carbon dioxide gas to different beer barrels, each gas line having the gas valve for introducing the carbon dioxide gas to the beer barrel and the leak valve for reducing the carbon dioxide gas from the beer barrel, and controlling the pressures in the beer barrels separately.

* * * * *

UNITED STATES PATENT AND TRADEMARK OFFICE

CERTIFICATE OF CORRECTION

PATENT NO. : 5,871,121

DATED : February 16, 1999

INVENTOR(S) : Masami Hashimoto & Masanobu Ishibashi

It is certified that error appears in the above-indentified patent and that said Letters Patent is hereby corrected as shown below:

In column 1, line 23, change "barrel" to --barrels--; line 29, delete "one of", and change "barrels" to --barrel--;

In column 3, line 54, change "a" to --an--;

In column 6, line 62, change "have" to --has--; and

In column 7, line 25, add comma before "additional".

Signed and Sealed this

Tenth Day of August, 1999

*Attest:*

*Attesting Officer*

Q. TODD DICKINSON

*Acting Commissioner of Patents and Trademarks*